US006349575B1

(12) United States Patent
Bentley

(10) Patent No.: US 6,349,575 B1
(45) Date of Patent: Feb. 26, 2002

(54) CABLE LOCK SYSTEM

(76) Inventor: James K. Bentley, 2489 Starling Dr., Paso Robles, CA (US) 93446

( * ) Notice: Subject to any disclaimer, the term of this patent is extended or adjusted under 35 U.S.C. 154(b) by 0 days.

(21) Appl. No.: 09/579,377

(22) Filed: May 26, 2000

(51) Int. Cl.[7] ..... E05B 60/00
(52) U.S. Cl. ..... 70/18; 70/14; 70/30; 70/57; 70/233
(58) Field of Search ..... 70/14, 18, 19, 70/57, 58, 32, 34, 30, 49, 233

(56) References Cited

U.S. PATENT DOCUMENTS 5,060,491 A * 10/1991 Smith ..... 70/63
6,205,824 B1 * 3/2001 Miao ..... 70/58
6,244,082 B1 * 6/2001 Avganim ..... 70/58

* cited by examiner

*Primary Examiner*—William A. Cuchlinski, Jr.
*Assistant Examiner*—Olga Hernandez

(74) *Attorney, Agent, or Firm*—Charles C. Logan, II

(57) ABSTRACT

A cable lock system having a length of cable, a female lock housing and a male lock housing. The cable has a lug attached to each of its ends and after the cable is wound through the various apertures of items to be secured, the lugs are inserted into lug apertures in the side wall of the tubular sleeve portion of the female lock housing. The male lock housing has a cylinder bore hole and a lock having a locking tang fixedly secured in the cylindrical bore hole. The male lock housing is telescopically received in the bore hole of the female lock housing with its front end pressed against the respective lugs on the end of the cable member. By turning a key in the lock, the locking tang is directed radially outward into an internal annular groove in the female lock housing thereby preventing removal of the male lock housing from the female lock housing. The structure of the assembled parts prevents access to a rounded head nut on a carriage bolt that secures the female lock housing to a support wall. The support wall could be that of a tool box in the bed of a pick-up truck or one of the walls of the bed of the pick-up. A first alternative embodiment utilizes a closed loop at each end of the cable instead of cable lugs.

23 Claims, 4 Drawing Sheets

CABLE LOCK SYSTEM

BACKGROUND OF THE INVENTION

The invention relates to locks and primarily to a cable locking system for securing tools and other hardware stored in the bed of a pickup truck. An alternative embodiment can be used for locking bicycles and other items to prevent their removal.

Construction workers often carry tools and other equipment in the bed of their pickup trucks. Quite often these items are stolen from the bed of a pick-up truck since the worker cannot always have the truck in his line of sight. Presently there is not a locking system available that would prevent tools and equipment from being stolen from the bed of a pickup truck.

It is an object of the invention to provide a novel cable lock system that can be used for securing tools and other equipment stored in the bed of a pickup truck.

It is also an object of the invention to provide a novel cable lock system having a female lock housing that can be secured to the wall of a tool chest or to the wall of a truck bed with all of the hardware for fastening the female lock housing hidden from view and access.

It is another object of the invention to provide a cable lock system that can be easily installed by the owner of a pickup truck.

It is a further object of the invention to provide a novel cable lock system that is economical to manufacture and market.

It is an additional object to provide a novel cable lock system that is fairly lightweight.

It also an object of the invention to provide a novel cable lock system having a cable made of braided metal wire covered by a tubular plastic sleeve thereby making it extremely difficult to cut or sever.

It is another object of the invention to provide a novel cable lock system having a female lock housing and a male lock housing each having clean design lines and an attractive appearance.

SUMMARY OF THE INVENTION

The novel cable lock system has been primarily designed for use in the bed of a pick-up truck for securing equipment and tools so they will not be stolen. It can also be used in other environments.

The cable lock system has three main components and they are a length of cable, a female lock housing and a male lock housing. The only hardware required to mount the female lock housing is a carriage bolt having a rounded head and a rounded head nut. The female lock housing would be secured to a wall member such as a tool chest or one of the walls in the truck bed. A hole would be drilled through the wall member and the carriage bolt would be fed from the inside of the wall member through the aperture and into the interior of the tubular sleeve portion of the female lock housing. The hexhead nut would be threaded onto the threaded shank of the carriage bolt thereby rigidly securing it in place. The only external access outside of the wall member to the hardware fastening the female lock housing to the wall member would be internally hidden in the tubular sleeve portion.

The length of cable is preferably made of braided metal wire that is covered by a tubular plastic sleeve. A lug is secured on each end of the cable and these lugs have a tubular body having a narrowed neck portion and a head. After the cable has been threaded through the tools and equipment in the bed of the pickup truck, the head of each of the lugs is inserted into one of the lug apertures in the side wall of the tubular sleeve portion of the female lock housing. Each of these lug apertures has an elongated slot extending therefrom having a width narrower than that of the diameter of the lug aperture. When the head of the lug is inserted into the lug aperture, the neck portion is slid into the slot thereby restraining removal of the lug.

The male lock housing has a cylindrical member having an annular flange at its front end. The cylindrical member telescopes into the bore of the female lock housing and the front end of the cylindrical member is positioned adjacent the head of the respective lug members to prevent their removal. The male lock housing has a bore hole extending from its end to its rear end that telescopically receives a lock. A set screw extending laterally through the cylindrical member threads into the lock thereby securing it in position. The cylindrical member also has a tang aperture that communicates with the locking tang of the lock. The bore hole of the female lock housing has an internal annular groove aligned adjacent the tang aperture so that when the key of the lock is turned, the locking tang moves radially and will extend into the internal annular groove of the female lock housing and be captured therein.

Both the female lock housing and the male lock housing are made of machined steel and are not susceptible to being cut with a metal saw or bolt cutters.

One alternative embodiment of the cable lock system has closed loops on the respective ends of the cable. Another alternative embodiment works extremely well in securing bicycles.

DESCRIPTION OF THE PREFERRED EMBODIMENT

Figure 1:
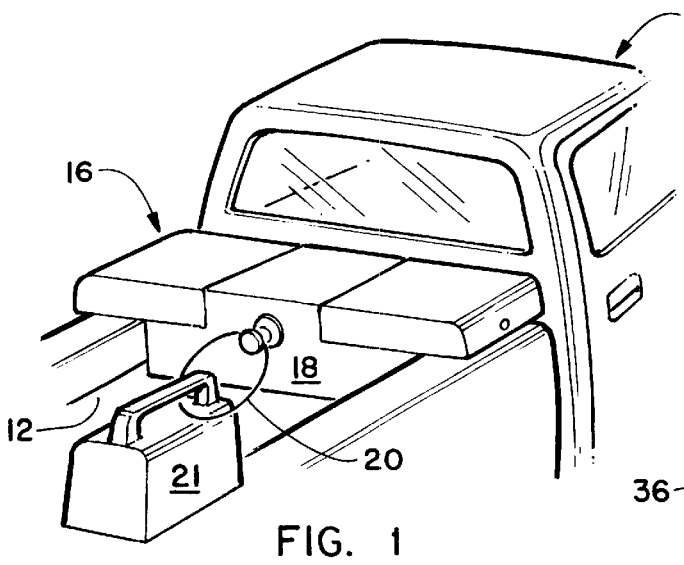
FIG. 1 is a partial rear perspective view of the bed of a pick-up truck illustrating the cable lock system installed therein.
Figure 2:
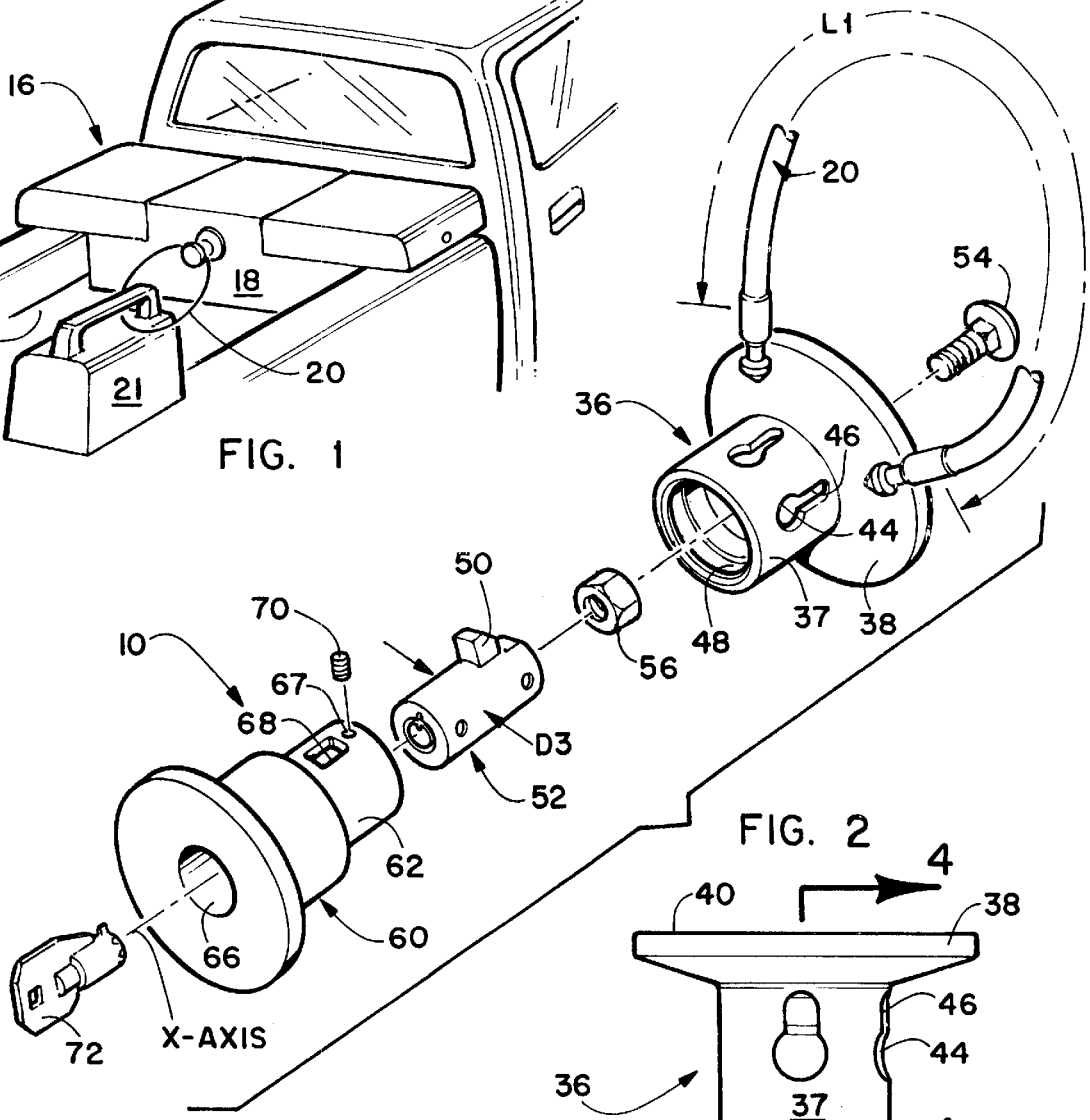
FIG. 2 is an exploded front perspective view of the novel cable lock system.
Figure 3:
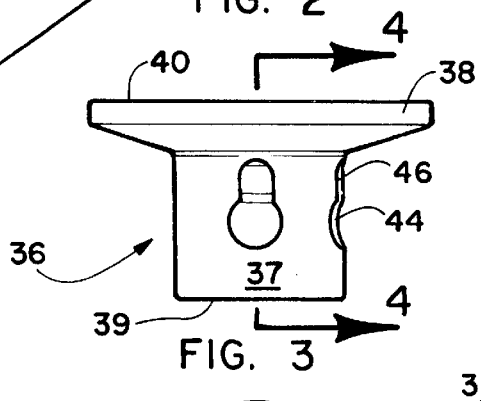
FIG. 3 is a side elevation view of the female lock housing.
Figure 4:
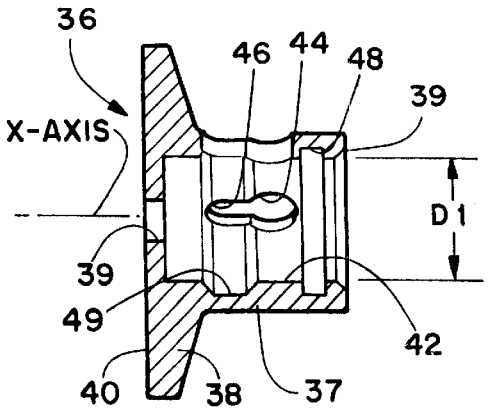
FIG. 4 is a cross sectional view taken along lines 4—4 of FIG. 3.
Figure 5:
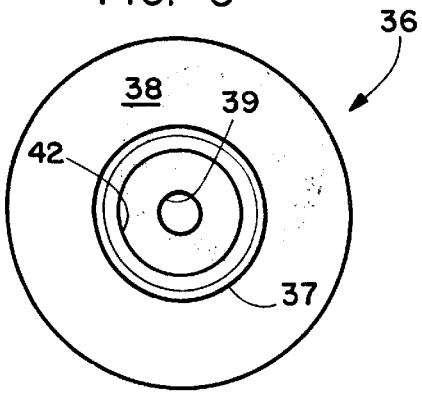
FIG. 5 is a front elevation view of the female lock housing.
Figure 6:
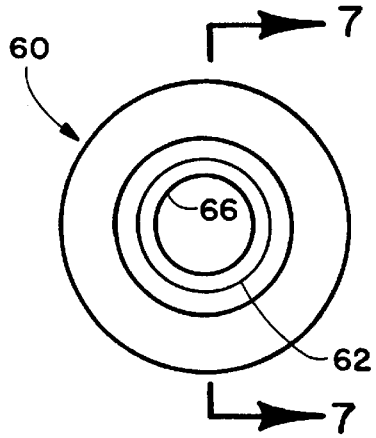
FIG. 6 is a rear elevation view of the male lock housing.
Figure 7:
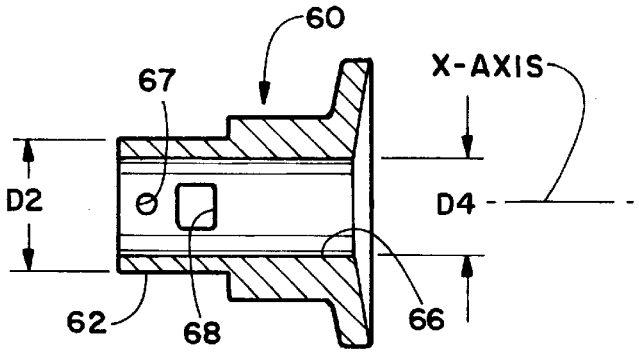
FIG. 7 is a cross sectional view taken along lines 7—7 of FIG. 6.
Figure 8:
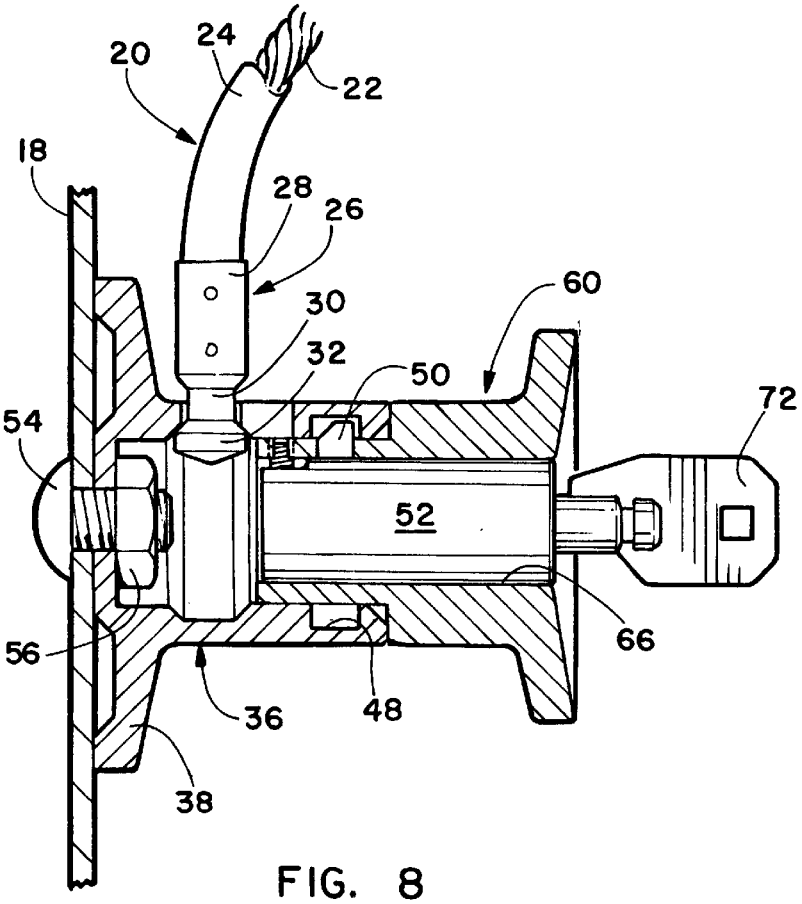
FIG. 8 is a cross sectional view taken through the assembled structure of the female lock housing and the male lock housing.

The novel cable lock system is generally designated numeral 10 and will be described by referring to FIGS. 1–8 of the drawings. In FIG. 1, the cable lock system 10 is installed in the bed 12 of a pickup truck 14. The tool box 16 has a rear wall 18 to which the hardware has been attached. Cable assembly 20 is passed through the handle of a generator 21.

Cable assembly 20 has a predetermined length L1 in the range of 1–20 feet. It has a braided cable member 22 formed from metal wire that is covered by a tubular plastic sleeve 24. A lug 26 is secured to each of its opposite ends. Each lug 26 has a tubular body 28, a narrowed neck portion 30 and a head 32.

Female lock housing 36 has a tubular sleeve portion 37 and a base portion 38. It has a front end 39 and a rear end 40. It also has a longitudinally extending X-axis that passes through its bore hole 42 that has a diameter D1. A pair of laterally spaced lug apertures 44 are formed in tubular sleeve portion 37 and they each have a slot 46 having a narrow width. A first internal annular groove 48 is also formed in tubular sleeve portion 37 adjacent its front end for receiving the locking tang 50 of a lock 52. A second internal annular groove 49 is also formed in tubular sleeve portion 37 adjacent its rear end for capturing the head 32 of lug 26. Base portion 38 has a aperture 39 through which the shank of a carriage bolt 54 would be inserted. Nut 56 would be tightened thereon to secure female lock housing 36 to support wall member 18.

Male lock housing 60 has a cylindrical portion 62 whose outer diameter is D2 and D2 is less than D1 which is the diameter of the bore in tubular sleeve 37. A shoulder 63 is formed on cylinder portion 62 that abuts the front end 39 of tubular sleeve portion 37. Lock 52 has a diameter D3 which is slightly less than the diameter D4 of bore hole 66 and is telescopically received therein. A set screw aperture 67 and a tang aperture 68 are formed in cylindrical member 62. A set screw 70 passes through aperture 67 and is threadably received in lock 52 and secured in a fixed position. Locking tang 50 moves radially outward when the key 72 is turned causing locking tang 50 to pass through tang aperture 68 and then into internal annular groove 48 where it is captured and thus prevents male lock housing 60 from being removed from female lock housing 36.

Figure 9:
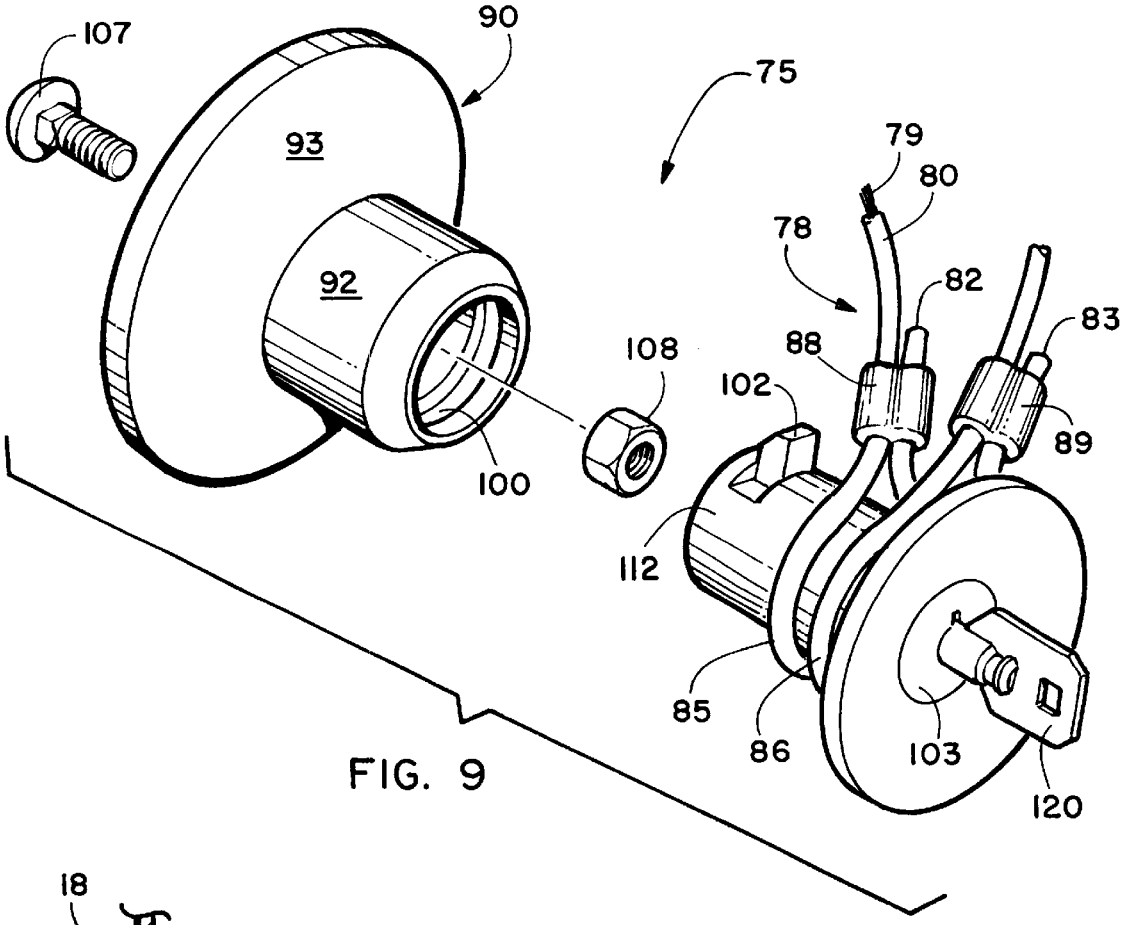
FIG. 9 is an exploded front perspective view of a first alternative embodiment of the novel cable lock system.
Figure 10:
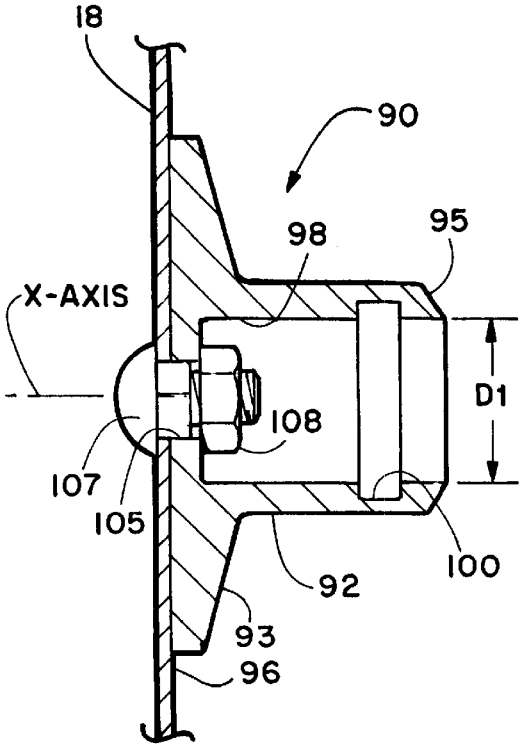
FIG. 10 is a vertical cross sectional view of the female lock housing of said first alternative embodiment.
Figure 11:
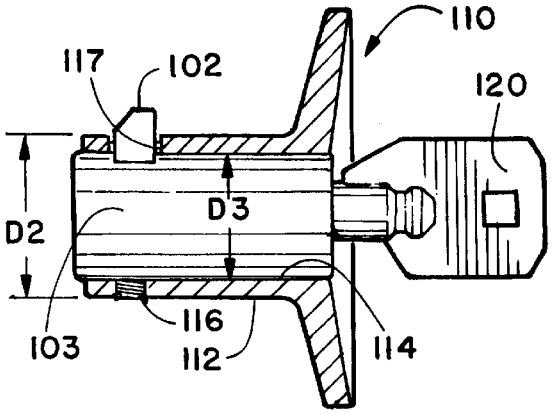
FIG. 11 is a vertical cross sectional view of the male lock housing of said first alternative embodiment.
Figure 12:
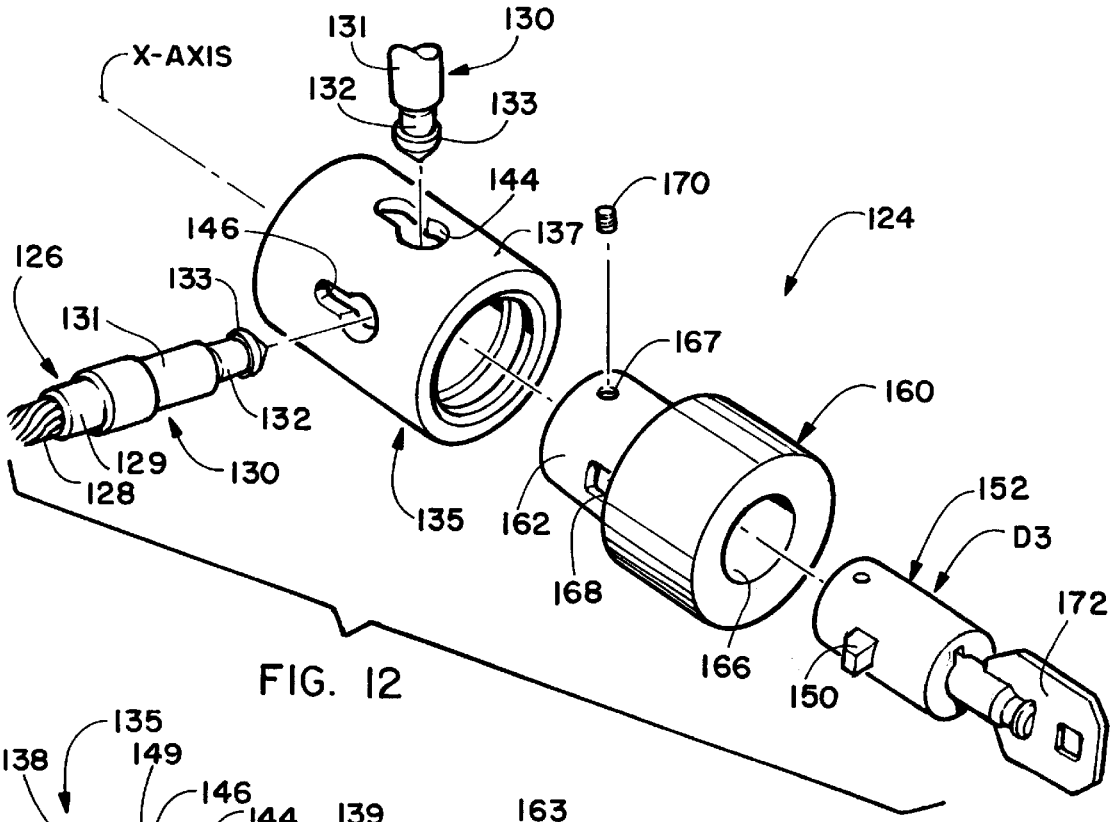
FIG. 12 is an exploded front perspective view of a second alternative embodiment of the novel cable lock system.
Figure 13:
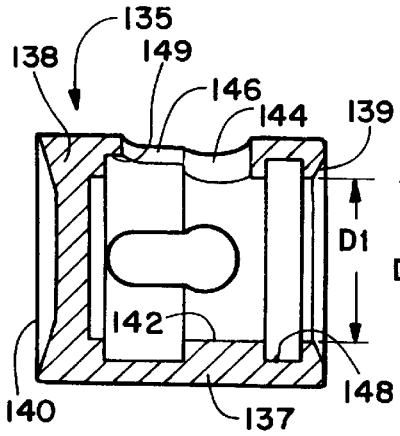
FIG. 13 is a vertical cross sectional view of the female lock housing of said second alternative embodiment.
Figure 14:
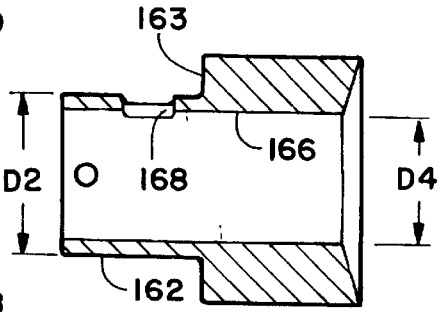
FIG. 14 is a vertical cross sectional view of the male lock housing of said second alternative embodiment.
Figure 15:
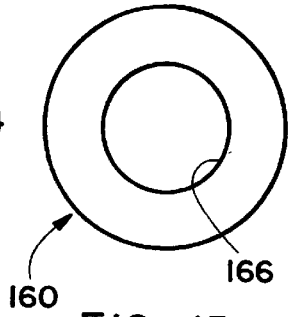
FIG. 15 is a front elevation view of the male lock housing of said second alternative embodiment.
Figure 16:
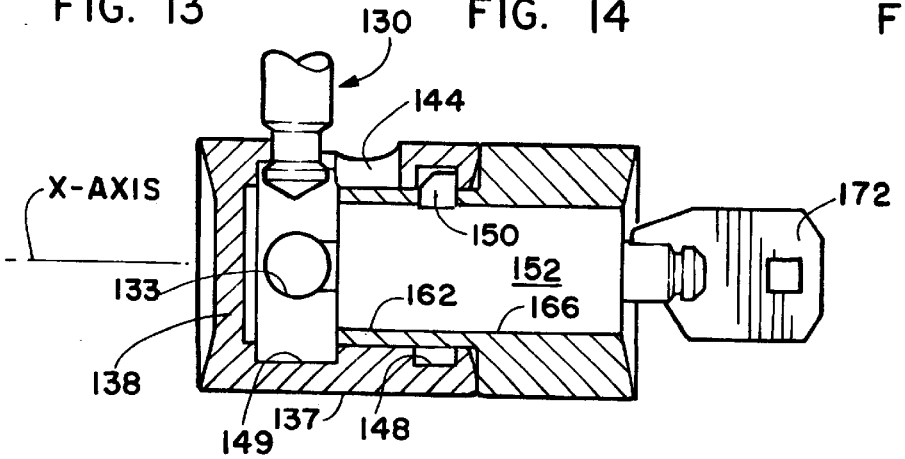
FIG. 16 is a vertical cross sectional view of the assembled second alternative embodiment of the novel cable lock system.

A first alternative embodiment of the novel cable lock system is illustrated in FIGS. 9–11. The cable lock system is generally designated numeral 75.

Cable assembly 78 has a predetermined length L1 in the range of 1–20 feet. It has a braided cable member 79 formed from metal wire that is covered by a tubular plastic sleeve 80. Cable member 79 has a first end 82 and a second end 83. The respective ends 82 and 83 have been looped backed upon the wire cable member 79 to form closed loops 85 and 86 that are permanently secured by clamps 88 and 89.

Female lock housing 90 has a tubular sleeve portion 92 and a base portion 93. It has a beveled front end 95 and a rear end 96. It also has a longitudinally extending X-axis that passes through its bore hole 98 that has a diameter D1. A first internal annular groove 100 is also formed in tubular sleeve portion 92 adjacent its front end for receiving the locking tang 102 of a lock 103. Base portion 93 has an aperture 105 into which the shank of a carriage bolt 107 would be inserted. Nut 108 would be tightened thereon to secure female lock housing 90 to support wall member 18. Male lock housing 110 has a cylindrical member portion 112 whose outer diameter is D2 and D2 is less than D1 which is the diameter of the bore in tubular sleeve portion 92. Lock 103 has a diameter D3 which is slightly less than the diameter D4 of bore hole 114 and it is telescopically received therein. A set screw aperture 116 and a tang aperture 117 are formed in cylindrical member 112. A set screw passes through set screw aperture 116 and is threadably received in a threaded aperture in lock 103 to secure it in a fixed position. Locking tang 102 moves radially outward when the key 120 is turned causing locking tang 102 to pass through tang aperture 117 and then into internal annular groove 100 where it is captured and thus prevents male lock housing 110 from being removed from female lock housing 90.

A second alternative embodiment of the novel lock system is generally designated numeral 124 and will be described by referring to FIGS. 12–16 of the drawings.

Cable assembly 126 has a predetermined length L1 in range of 1–20 feet. It has a braided cable member 128 formed from metal wire that is covered by a tubular plastic sleeve 129. A cable lug 130 is secured to each of its opposite ends. Each cable lug 130 has a tubular body 131, a narrowed neck portion 132 and a head 133.

Female lock housing 135 has a tubular sleeve portion 137 and a base portion 138. It has a front end 139 and a rear end 140. It also has a longitudinally extending X-axis that passes through its bore hole 142 that has a diameter D1. A pair of laterally spaced lug apertures 144 are formed in tubular sleeve portion 137 and they each have a slot 146 having a narrowed width. A first internal annular groove 148 is also formed in tubular sleeve portion 137 adjacent its front end for receiving the locking tang 150 of a key lock 152. A second internal annular groove 149 is also formed in tubular sleeve portion 137 adjacent its rear end for capturing the heads 133 of lugs 130.

Male lock housing 160 has a cylindrical member portion 162 whose outer diameter is D2 and D2 is less than D1 which is the diameter of bore hole 142 in tubular sleeve 137. A shoulder 163 is formed on cylindrical member portion 162 that abuts the front end 139 of tubular sleeve portion 137. Lock 152 has a diameter D3 which is slightly less than the diameter D4 of bore hole 166 and it is telescopically received therein. A set screw aperture 167 and a tang aperture 168 are formed in cylindrical member portion 162. A set screw 170 passes through aperture 167 and is threadably received in lock 152 to secure it in a fixed position. Locking tang 150 moves radially outward when the key 172 is turned causing locking tang 150 to pass through tang aperture 168 and then into internal annular groove 148 where it is captured and thus prevents male lock housing 160 from being removed from female lock housing 135.

What is claimed is:

1. A cable lock system comprising:

a cable assembly having an elongated cable member having a predetermined length L1; a first end and a second end; a first cable lug secured to said first end of said cable member; and a second cable lug secured to said second end of said cable member;

a female lock housing having a tubular sleeve portion having a front end, a rear end, a longitudinally extending X-axis, and a longitudinally extending bore hole having a diameter D1; a base portion having a front end that is connected to said rear end of said tubular sleeve portion; said base portion having a rear end and an aperture that communicates with said bore hole of said tubular sleeve portion;

means for detachably attaching said first and second cable lugs to said female lock housing;

a male lock housing having an elongated cylindrical member, said male lock housing having a front end, a rear end, a longitudinally extending X-axis; said cylindrical member having an outer diameter D2 and D2 is less than D1; said cylindrical member having a bore hole having a diameter D4; an elongated cylindrically shaped key lock having an outer diameter D3 and D3 is less than D4 so that said key lock can be telescopically received in said bore of said cylindrical member; means for restraining said key lock in said bore of said cylindrical member;

means for locking said first and second cable lugs to said tubular sleeve portion of said female lock housing; and means for locking said cylindrical member of said male lock housing inside said bore hole of said tubular sleeve portion of said female lock housing.

2. A cable lock system as recited in claim 1 further comprising means for fastening said female lock housing to a stationary wall member.

3. A cable lock system as recited in claim 1 wherein said cable member is covered by a tubular plastic sleeve.

4. A cable lock system as recited in claim 1 wherein said cable member is made of braided metal wire.

5. A cable lock system as recited in claim 1 wherein L1 is in the range of 1–20 feet.

6. A cable lock system as recited in claim 1 wherein said male lock housing has an annular flange on its front end to allow said male lock housing to be easily gripped when it is telescopically removed from said female lock housing.

7. A cable lock system as recited in claim 1 further comprising means for fastening said female lock housing to a stationary wall member.

8. A cable lock system as recited in claim 1 wherein said lugs each have a tubular body, a reduced diameter neck portion and a head.

9. A cable lock system as recited in claim 8 wherein said means for detachably attaching said first and second cable lugs to said female lock housing comprises a pair of laterally spaced lug apertures in said tubular sleeve portion of said female lock housing; each of said lug apertures communicates with a slot that extends away from said lug aperture thereby providing a slot into which said neck portion of said lug can be slid and captured.

10. A cable lock system as recited in claim 8 wherein said means for locking said first and second cable lugs to said tubular sleeve portion of said female lock housing is said front end of said cylindrical member that blocks longitudinal movement of said lugs when they have been slid into said slots extending outwardly from said lug apertures of said female lock housing thereby preventing removal of said lugs from said lug apertures.

11. A cable lock system as recited in claim 1 wherein said means for locking said cylindrical member of said male lock housing inside said tubular sleeve portion of said female lock housing comprises a tang aperture in said cylindrical member of said male lock housing; said lock having a locking tang that is aligned with said tang aperture; said tubular sleeve portion of said female lock housing having an internal annular groove in its bore that aligns with said tang aperture so that when a person turns the key in said lock, said locking tang will pass radially through said tang aperture and extend into said internal annular groove thereby preventing removal of said male lock housing from said female lock housing.

12. A cable lock system comprising:

a cable assembly having an elongated cable member having a predetermined length L1; a first end and a second end; a first closed loop formed adjacent said first end of said cable member; and a second closed loop formed adjacent said second end of said cable member;

a female lock housing having a tubular sleeve portion having a front end, a rear end, a longitudinally extending X-axis, and a longitudinally extending bore hole having a diameter D1; a base portion having a front end that is connected to said rear end of said tubular sleeve portion; said base portion having a rear end and an aperture that communicates with said bore hole of said tubular sleeve portion;

a male lock housing having an elongated cylindrical member, said male lock housing having a front end, a rear end, a longitudinally extending X-axis; said cylindrical member having an outer diameter D2 and D2 is less than D1; said cylindrical member having a bore hole having a diameter D4; an elongated cylindrically shaped key lock having an outer diameter D3 and D3 is less than D4 so that said key lock can be telescopically received in said bore of said cylindrical member; means for restraining said key lock in said bore of said cylindrical member;

means for detachably looping said first and second closed loops over said cylindrical member of said male lock housing; and means for locking said cylindrical member of said male lock housing inside said bore hole of said tubular sleeve portion of said female lock housing.

13. A cable lock system as recited in claim 12 wherein said cable member is covered by a tubular plastic sleeve.

14. A cable lock system as recited in claim 12 wherein L1 is in the range of 1–20 feet.

15. A cable lock system as recited in claim 12 wherein said male lock housing has an annular flange on its front end to allow said male lock housing to be easily gripped when it is telescopically removed from said female lock housing.

16. A cable lock system as recited in claim 12 wherein said means for locking said cylindrical member of said male lock housing inside said tubular sleeve portion of said female lock housing comprises a tang aperture in said cylindrical member of said male lock housing; said lock having a locking tang that is aligned with said tang aperture; said tubular sleeve portion of said female lock housing having an internal annular groove in its bore that aligns with said tang aperture so that when a person turns the key in said lock, said locking tang will pass radially through said tang aperture and extend into said internal annular groove thereby preventing removal of said male lock housing from said female lock housing.

17. A cable lock system comprising:

a cable assembly having an elongated cable member having a predetermined length L1; a first end and a second end; a first cable lug secured to said first end of said cable member; and a second cable lug secured to said second end of said cable member;

a female lock housing having a tubular sleeve portion having a front end, a rear end, a longitudinally extending X-axis, and a longitudinally extending bore hole having a diameter D1; a base portion having a front end that is connected to said rear end of said tubular sleeve portion;

means for detachably attaching said first and second cable lugs to said female lock housing;

a male lock housing having an elongated cylindrical member, said male lock housing having a front end, a rear end, a longitudinally extending X-axis; said cylindrical member having an outer diameter D2 and D2 is less than D1; said cylindrical member having a bore hole having a diameter D4; an elongated cylindrically shaped key lock having an outer diameter D3 and D3 is less than D4 so that said key lock can be telescopically received in said bore of said cylindrical member; means for restraining said key lock in said bore of said cylindrical member;

means for locking said first and second cable lugs to said tubular sleeve portion of said female lock housing; and means for locking said cylindrical member of said male lock housing inside said bore hole of said tubular sleeve portion of said female lock housing.

18. A cable lock system as recited in claim 17 wherein said cable member is covered by a tubular plastic sleeve.

19. A cable lock system as recited in claim 17 wherein L1 is in the range of 1–20 feet.

20. A cable lock system as recited in claim 17 wherein said lugs each have a tubular body, a reduced diameter neck portion and a head.

21. A cable lock system as recited in claim 20 wherein said means for detachably attaching said first and second cable lugs to said female lock housing comprises a pair of laterally spaced lug apertures in said tubular sleeve portion of said female lock housing; each of said lug apertures communicates with a slot that extends away from said lug aperture thereby providing a slot into which said neck portion of said lug can be slid and captured.

22. A cable lock system as recited in claim 20 wherein said means for locking said first and second cable lugs to said tubular sleeve portion of said female lock housing is said front end of said cylindrical member that blocks longitudinal movement of said lugs when they have been slid into said slots extending outwardly from said lug apertures of said female lock housing thereby preventing removal of said lugs from said lug apertures.

23. A cable lock system as recited in claim 17 wherein said means for locking said cylindrical member of said male lock housing inside said tubular sleeve portion of said female lock housing comprises a tang aperture in said cylindrical member of said male lock housing; said lock having a locking tang that is aligned with said tang aperture; said tubular sleeve portion of said female lock housing having an internal annular groove in its bore that aligns with said tang aperture so that when a person turns the key in said lock, said locking tang will pass radially through said tang aperture and extend into said internal annular groove thereby preventing removal of said male lock housing from said female lock housing.

* * * * *